United States Patent [19]

Vanelderen et al.

[11] Patent Number: 4,621,675

[45] Date of Patent: Nov. 11, 1986

[54] PROCESS AND APPARATUS FOR CONTINUOUS CASTING

[75] Inventors: Yvon L. Vanelderen; Christian L. G. Raskin, both of Olen; René E. J. Mortier, Kasterlee; John M. A. Dompas, Olen, all of Belgium

[73] Assignee: Hazelett Strip-Casting Corporation, Malletts Bay, Vt.

[21] Appl. No.: 753,815

[22] Filed: Jul. 9, 1985

Related U.S. Application Data

[63] Continuation of Ser. No. 422,946, Sep. 24, 1982, abandoned.

[51] Int. Cl.[4] ..... B22D 11/06

[52] U.S. Cl. ..... 164/481; 164/485; 164/431; 164/443

[58] Field of Search ..... 164/481, 485, 431, 443

[56] References Cited

U.S. PATENT DOCUMENTS

| | | | |
|---|---|---|---|
| 2,515,284 | 7/1950 | Zeigler et al. | 164/485 X |
| 2,791,812 | 5/1957 | Dangelzer | 164/444 |
| 3,036,348 | 5/1962 | Hazelett et al. . | |
| 3,512,574 | 5/1970 | Taylor | 164/444 X |
| 3,937,274 | 2/1976 | Dompas | 164/481 X |
| 4,276,921 | 7/1981 | Lemmens et al. | 164/4 |
| 4,367,783 | 1/1983 | Wood et al. | 164/452 |

FOREIGN PATENT DOCUMENTS

| | | | |
|---|---|---|---|
| 122633 | 9/1979 | Japan | 164/443 |

*Primary Examiner*—Kuang Y. Lin

*Attorney, Agent, or Firm*—Parmelee, Bollinger & Bramblett

[57] ABSTRACT

Process and apparatus for continuous casting in a twin-belt casting machine in which the moving side dams are guided along opposite sides of the moulding cavity by guide device extending along beside the respective moving side dams, and the moving side dams are cooled by cooling fluid circulated in at least a part of the guide device and applied directly to the moving side dams. The moving side dams are cooled by cooling fluid sprayed through orifices in the guide device directly onto the moving side dams along at least a part of the downstream zone of the moulding cavity. During movement of the side dams along the moulding cavity from its entrance to its exit, they pass successively through a first (or upstream) zone in which they face molten metal and through a second (or downstream) zone in which they face solidified metal. The cooling fluid is sprayed directly onto the moving side dams only in this second zone. The first zone occupies from approximately 3/10ths to approximately 1/2 of the overall length of the moulding cavity, and the second zone occupies the remainder. The cooling fluid is advantageously sprayed directly toward the side dam for providing very effective cooling action, and this cooling fluid is aimed in a downstream direction that forms an acute angle with the moving direction of the side dam. Preferably this acute angle is in the range from approximately 20° to approximately 50° for propelling the cooling fluid downstream away from the first zone, and preferably the cooling fluid is water.

12 Claims, 6 Drawing Figures

PROCESS AND APPARATUS FOR CONTINUOUS CASTING

This is a continuation of co-pending application Ser. No. 422,946 filed on Sept. 24, 1982, now abandoned.

FIELD OF THE INVENTION

The present invention relates to process and apparatus for continuous casting of molten metal in a twin-belt casting machine.

BACKGROUND OF THE INVENTION

In a twin-belt casting machine the moulding cavity is formed by means of moving walls, the lower wall being formed by the upper run of a lower endless flexible belt, the upper wall being formed by the lower run of an upper endless flexible belt, and the side walls being formed by a pair of spaced endless side dams, that move with the belts along the opposite sides of the moulding cavity from the inlet (or entrance) to the outlet (or exit) thereof and that are guided by guide means during their movement along the moulding cavity. The lower wall and the upper wall are cooled by contact with a cooling liquid on their respective reverse surfaces. That is, the cooling liquid is applied to the lower surface of the upper run of the lower belt, and the cooling liquid is also applied to the upper surface of the lower run of the upper belt.

Molten metal is fed in at the entrance of the moulding cavity, and a cast product is delivered at the outlet of the moulding cavity. Thus, the side dams pass during their movement along the moulding cavity successively through a first zone, in which they face molten metal and through a second zone located downstream from the first zone in which they face solidified metal.

Such a process and apparatus are described in U.S. Pat. No. 3,036,348. In this known process and apparatus, there is a fixed guide in the form of a guide bar extending for a substantial distance along the outer face of each side dam. This guide bar extends from the inlet towards the outlet of the moulding cavity and, during their movement along the moulding cavity, the side dams are only cooled by the contact of their upper and lower faces with the belts. As shown in FIG. 10 of that U.S. patent and as described in column 10, lines 60–70 therein, it is known in the twin-belt casting machine art to provide a longitudinal passageway in each stationary dam which rests on top of the respective moving side dam adjacent to the pool of molten metal near the entrance to the moulding cavity and to feed liquid coolant through such passageways for cooling the stationary side dams. It is also known in the twin-belt casting machine art to provide a longitudinal passageway in each guide bar and to feed liquid coolant through such a passageway for cooling the guide bar.

However, such guide bars and such stationary edge dams are stationary. Prior to the present invention, the moving side dams have only been cooled by the contact of their upper and lower surfaces with the belts. Relatively insignificant cooling is provided from such a stationary side dam or from such a stationary guide bar. Consequently, in the known process and apparatus relatively few calories are carried off from the moving side dams as they move along opposite sides of the moulding cavity. Thus, the moving side dams become heated to a relatively high temperature during their movement along the moulding cavity. Such repeated high temperature heating influences in an unfavorable way the lifetime of these side dams. This high temperature heating of the side dams also imposes limitations on the casting speed, especially when rather thick products are cast, for example, products with a thickness of five or more centimeters.

SUMMARY OF THE INVENTION

The aim of the present invention is to provide a process and apparatus that avoid the drawbacks of the above-known process and apparatus.

According to the present invention, a cooling fluid is circulated in at least a part of the fixed guides and this cooling fluid is sprayed through the fixed guides directly onto the moving side dams in at least a part of the aforesaid second zone in which the moving side dams face solidified metal.

The present invention relates to apparatus for continuous casting comprising a moulding cavity formed by means of moving walls, the lower wall being formed by the upper run of a lowr endless belt, the upper wall being formed by the lower run of an upper endless belt, and the side walls being formed by a pair of endless side dams, that are adapted to move with the belts along the opposite sides of the moulding cavity from the inlet to the outlet thereof, fixed guides to guide the side dams during their movement along the moulding cavity, means for spraying a cooling liquid on the reverse surfaces of the lower wall and upper wall, and a first zone, in which the side dams face liquid metal when the apparatus is running, and a second zone, in which the side dams face solidified metal when the apparatus is running, characterized in that the fixed guides are adpated to be cooled over at least a part of their length by circulation of a cooling fluid and they comprise means for spraying cooling fluid directly into the moving side dams in at least a part of the aforesaid second zone.

In the illustrative embodiment of the invention, as shown, the cooling fluid is advantageously sprayed directly toward the respective side dam for providing a very effective cooling action on the side dam as it is moving along the moulding cavity in the second zone facing the recently solidified metal, and the cooling fluid is aimed in a downstream direction for propelling the cooling fluid downstream away from the first zone in which the moving side dams face molten metal.

Other details and characteristics of the invention will result from the description of an embodiment of the process and apparatus according to the invention, given hereafter as a non-restrictive example and with reference to the accompanying drawings.

BRIEF DESCRIPTION OF THE DRAWINGS

The same reference notations indicate identical elements in the different FIGURES.

Figure 1:
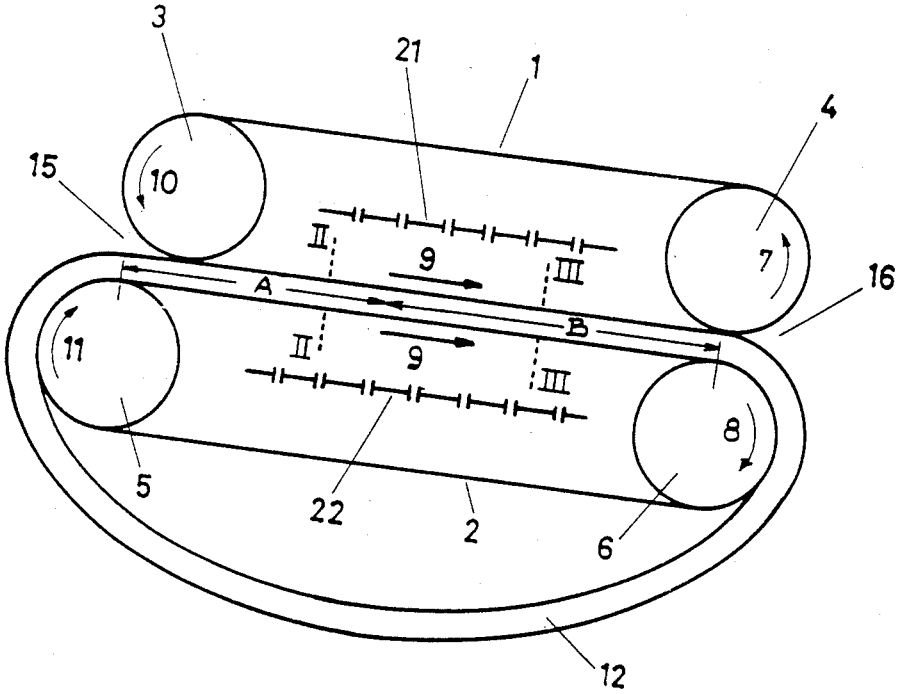
FIG. 1 is a schematic elevational lateral view of a twin-belt continuous casting apparatus according to the invention.
Figure 2:
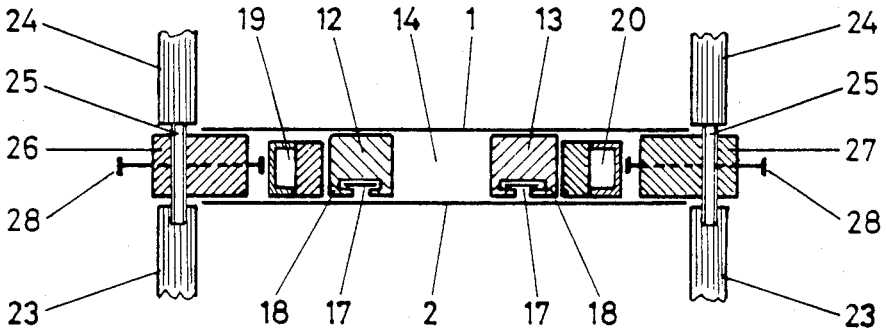
FIG. 2 represents an enlarged section through the apparatus of FIG. 1 made along line II—II of FIG. 1.
Figure 3:
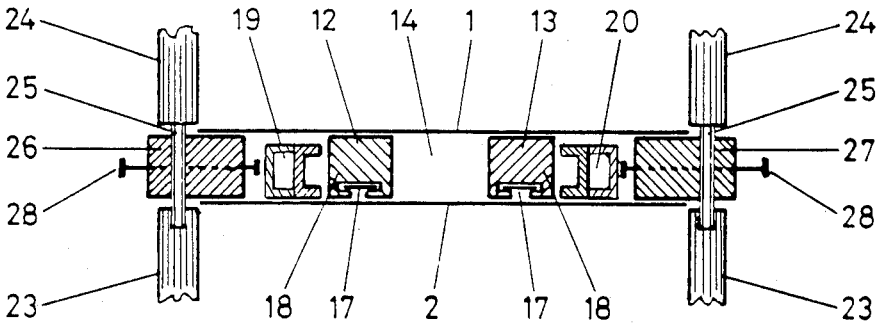
FIG. 3 represents an enlarged section through the apparatus of FIG. 1 made along line III—III of FIG. 1.

The apparatus shown in FIGS. 1 to 3 comprises an upper moving endless belt 1 and a lower moving endless belt 2. The upper belt 1 passes around rolls 3 and 4, and the lower belt 2 passes around rolls 5 and 6. Rolls 3 and 5 are driven in the direction indicated by arrows 10 and 11 and consequently drive belts 1 and 2 in the direction of arrows 9 and rolls 4 and 6 in the direction of arrows 7 and 8. Two moving endless side dams 12 and 13 are located partly between the lower run of the upper belt 1 and the upper run of the lower belt 2. The side dams 12 and 13 delimit with upper belt 1 and with the lower belt 2 a moulding cavity 14 between an inlet or entrance 15 and an outlet or exit 16. The movement of belts 1 and 2 causes the side dams 12 and 13 to move. These side dams move thus with belts 1 and 2 in the direction of arrows 9 from inlet 15 to outlet 16 of the moulding cavity 14.

The side dams 12 and 13 are formed by a metal strap 17 and by a large number of metal blocks 18 strung on this strap. When moving along the moulding cavity 14, the side dams 12 and 13 are guided by fixed guides 19 and 20 in order to avoid their sidewards movement toward the outside which would make the profile of the cast product irregular. The construction of fixed guides 19 and 20 will be described and more detailed further on.

The casting apparatus is supplied with molten metal by conventional metal feeding apparatus (not shown) feeding the moulding cavity 14 with molten metal. This feeding apparatus is located at inlet 15 of the moulding zone between side dams 12 and 13.

The metal is cooled in the moulding cavity 14 on the one hand by spraying a cooling liquid on the reverse surfaces of belts 1 and 2, respectively, as schematically illustrated at 21 and 22, as detailed in the aforesaid U.S. Pat. No. 3,036,348, and on the other hand by spraying a cooling liquid on side dams 12 and 13, as will be described further on.

At outlet 16 of moulding cavity 14 the cast product issues in the shape of a strip or bar, that is either entirely solidified or is composed of a solidified metal sheath or skin enclosing a liquid metal core.

The thickness of this strip or bar is determined by the distance between belts 1 and 2, and the width by the distance between the side dams 12 and 13.

Side dams 12 and 13 thus pass, during their movement, along the moulding cavity 14, successively through a first zone, for example, zone A, in which they face molten metal and through a second zone, for example, zone B, in which they face solidified metal. The length of the first zone A depends on a number of factors such as the nature and temperature of the cast metal, the section that is cast, the inclination of the moulding cavity, the nature of the walls of the moulding cavity, the intensity of the applied cooling, the casting speed, etc. This length of zone A can be computed for each case in particular. Normally, the length of zone A is in the range from approximately 3/10ths to approximately ½ of the overall length of the moulding cavity 14. Preferably, the casting operation is carried out under such conditions that this length of zone A amounts to about three to four tenths of the length of the moulding cavity, which means that the second zone B normally extends over at least the second half of the moulding cavity 14, and preferably extends over approximately 6/10ths to approximately 7/10ths of the total length of the moulding cavity.

Rolls 5 and 6 as well as the cooling system 22 of the lower belt 2 are mounted on a lower frame 23, and rolls 3 and 4 and the cooling system 21 of the upper belt 1, on the upper frame 24. The lower frame 23 and the upper frame 24 are spaced by a certain number of spacers 25, passing through two tightening or adjusting elements 26 and 27 and serving for keeping these elements in position. Rods 28, which enable the adjustment of the position of the fixed guides 19 and 20, pass through the tightening elements 26 and 27. For clarity of illustration frames 23 and 24, spacers 25, tightening elements 26 and 27, and regulating rods 28 are not shown in FIG. 1.

Figure 6:
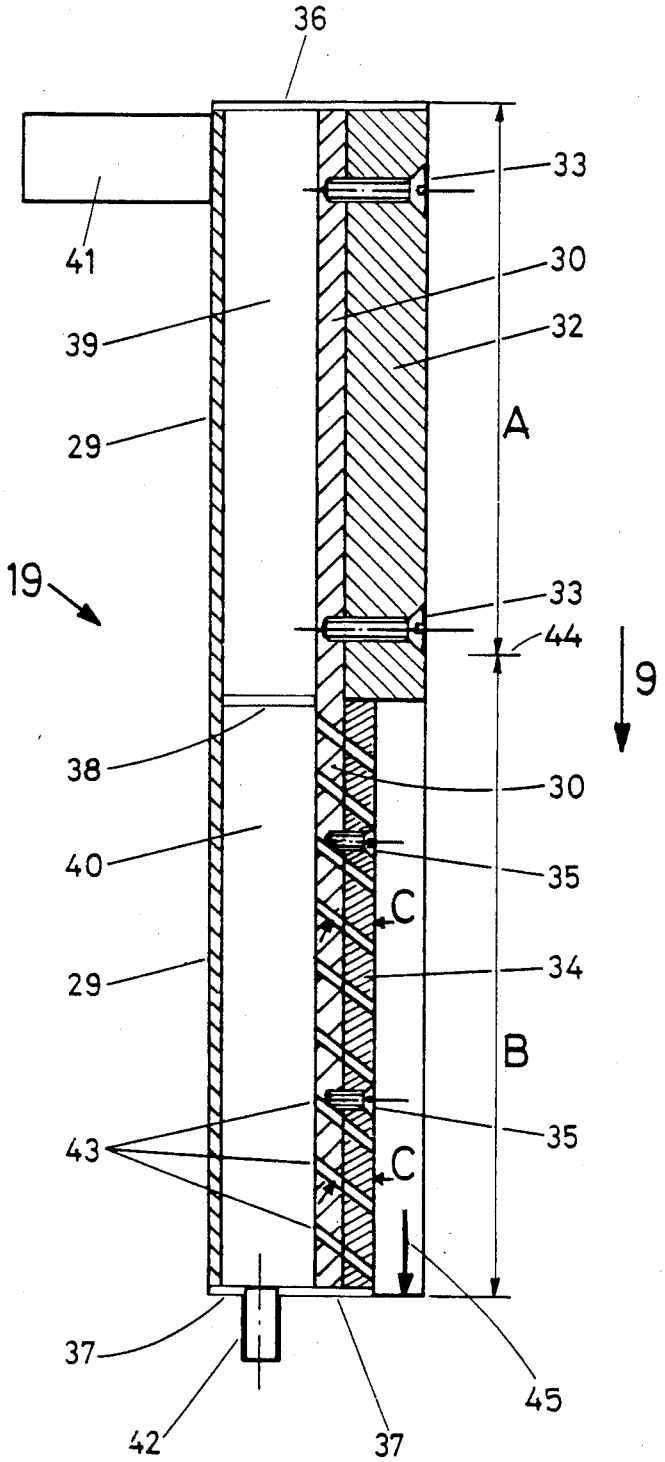
FIG. 6 represents an enlarged horizontal section through a fixed guide of the apparatus of FIG. 1.
Figure 4:
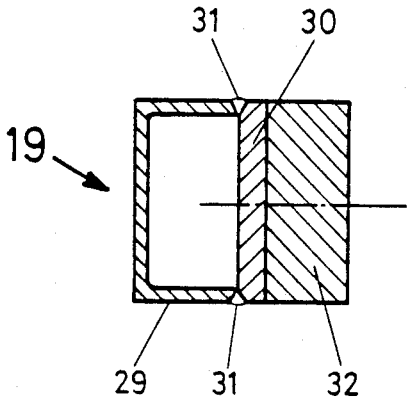
FIG. 4 is an enlarged and more detailed view of part of FIG. 2.
Figure 5:
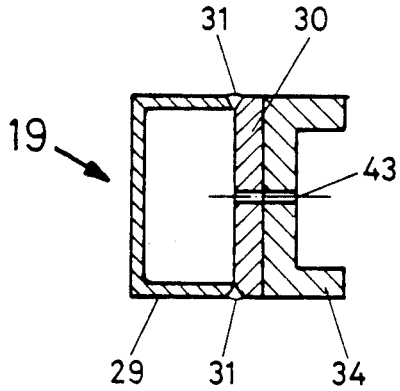
FIG. 5 is an enlarged and more detailed view of part of FIG. 3.

FIGS. 4 to 6 give a detailed view of the construction of the guide 19. This guide 19 is essentially composed of the following elements: a U-section 29; a flat section 30 welded at 31 to the legs of the U-section 29; a rectangular section 32 fixed by screws 33 (FIG. 6) to the flat section 30 on the end portion of the guide 19 nearer the inlet 15 of the moulding cavity 14; a U-section 34 fixed by screws 35 to the flat section 30 on the end portion of the guide 19 nearer the outlet 16 of the moulding cavity 14; a plate 36 closing section 29 on the upstream end of the guide 19 located near to the inlet 15; a plate 37 closing section 29 on the downstream end of the guide 19 located near to the outlet 16; a wall 38 separating a cavity 39 of section 29, that faces section 32, from a cavity 40 of section 29, that faces section 34; and a lug 41 to attach the guide to the lower frame 23. Moreover, there is a fluid supply port or opening 42 provided in the downstream end plate 37 and a series of fluid spray openings 43 provided in the wall formed by the juxtaposition of section 34 and flat section 30. Seen from inlet 15 of moulding cavity 14, the openings 43 are each directed at an acute angle C towards the downstream moving direction 9 of the side dams 12 and 13, preferably at an angle C of approximately 20° to approximately 50°.

When the casting apparatus is in operation, a cooling fluid, preferably such as water, is introduced through the supply opening 42 in cavity 40, from where it sprays out through the openings or orifices 43 in the direction of side dam 12, thereby being directly applied onto the moving side dam 12 along at least a portion of the second zone B of the moulding cavity 14. By virtue of the fact that the fluid spray openings or orifices 43 are directed downstream at the angle C, the fluid is propelled in a downstream direction away from the first zone A in which the side dam faces molten metal.

The fixed guide 19 as shown in FIG. 6 thus comprises a first upstream part, that is not adapted to spray cooling fluid on side dam 12 and that extends over at least zone A, and a second downstream part, that is adapted to spray cooling fluid on side dam 12 and that extends over at least a part of zone B. In the illustrative example both parts are shown as having almost the same length.

It is to be understood that a cooling liquid such as water must not be sprayed on the moving side dam 12 in zone A, where the side dam still faces liquid metal, since the water might reach this liquid metal, thereby causing the explosively sudden disruptive generation of steam. In order to obtain the most effective cooling of the moving edge dam 12, it is desired that the portion of the length of the zone B along which the liquid coolant is directly applied to the moving edge dam by the spray opening 43 in the guide 19 preferably be as large as possible. Thus, it is quite important that, in the application of the process and apparatus of this invention, there be an effective control of the liquid metal level at inlet 15 of the moulding cavity 14 for controlling the length of the first zone A for preventing the zone A from extending downstream beyond a predetermined limit 44. As shown in FIG. 6, said predetermined limit 44 is always located upstream from the most upstream one of the spray openings 43. Such control can be made by the process and apparatus described in U.S. Pat. No. 4,276,921.

It is to be understood that the other guide 20 is constructed like the guide 19, except it is a mirror image of the guide 19.

The U-section 34 of the guide 19 defines a channel, as seen in FIG. 3, adjacent to the outside surface of the side dam 12. Similarly, the corresponding U-section of the other guide 20 defines a channel adjacent to the outside surface of the other side dam 13. The spray openings 43 are aimed toward the outside surfaces of the respective side dams 12, 13 along these channels. These channels are open at their downstream ends, as seen in FIG. 6, for allowing the cooling fluid which has been applied to the side dams to escape near the outlet or exit 16 (FIG. 1). As described above, the downstream angle C of the multiple spray openings 43 propels the cooling fluid in a downstream direction toward the open end of this channel as shown by the arrow 45 in FIG. 6.

Moreover, it is to be understood that numerous variants of the afore-described guide 19 can be used in the process and apparatus of this invention. So, for example, it is possible to include such modifications as the following: Eliminate the wall 38 so that the cooling fluid might also circulate in the cavity 39. Eliminate the wall 38 and provide in the end plate 36 an outlet opening, with a small diameter (smaller than the size of the supply port 42), for the cooling fluid circulating in cavity 39 to exit. Eliminate the wall 38 and the opening 42 and provide in the end plate 36 a supply opening for the introduction of the cooling fluid. Replace section 32 by a hollow section and make the cooling fluid circulate in the cavity of this section, etc.

It should be noted that when casting a copper bar with a thickness of 70 mm and a width of 130 mm, the direct cooling of the side dams in zone B through the fixed guides, as shown in FIGS. 4 to 6, advantageously allowed the casting speed to be increased by approximately 10%; in other words, the tonnage production per hour of such copper bar was increased by approximately 10%.

We claim:

1. A process for continuous casting according to which a moulding cavity is formed by means of moving walls having lower and upper walls formed by lower and upper revolving endless belts each having upper and lower runs, the lower wall being formed by the upper run of said lower endless belt, the upper wall being formed by the lower run of said upper endless belt and the side walls being formed by a pair of endless side dams, that move with the belts along the moulding cavity from the inlet to the outlet thereof and that are guided by a pair of fixed guides during their movement along the moulding cavity, each of said side dams has an inside surface and on outside surface, said outside surface is adjacent to the respective fixed guide which is guiding the respective moving side dam, the lower wall and the upper wall are cooled by contact with a cooling liquid, and molten metal is fed at the inlet of the moulding cavity and a cast product is delivered at the outlet of the moulding cavity, the side dams thus passing during their movement along the moulding cavity successively through a first zone, in which their inside surfaces face molten metal and through a second zone, in which their inside surfaces face solidified metal, this process being characterized by the steps of:

in said second zone providing a longitudinal channel extending along each respective fixed guide adjacent to the outside surface of the respective moving side dam, providing an open end of each channel near the outlet of the moulding cavity, circulating cooling fluid in at least a part of each of said fixed guides, preventing the direct application to said side dams of the cooling fluid circulated in said fixed guides while said side dams are passing through said first zone, spraying the cooling fluid from each of the fixed guides into the respective longitudinal channel and directly applied onto the outside surface of the respective side dam during at least a portion of the movement of each of the side dams through said second zone, the cooling fluid being sprayed from the respective fixed guide into the longitudinal channel at multiple locations spaced along said channel in a direction that, seen from the inlet of the moulding cavity, forms an acute angle with the outside surface of the respective moving side dam, said spraying direction at said multiple locations propelling the cooling fluid in the respective channel in a downstream direction toward said open end of the channel, allowing the cooling fluid to escape through said open end of the channel, and controlling the molten metal for controlling the length of the first zone for preventing the first zone from extending downstream beyond a predetermined limit for keeping said limit always upstream from said spraying, thereby selectively cooling the outside surface of the side dams during travel along the moulding cavity to limit heating of the side dams as they are passing along the moulding cavity for enabling increase in the operating lifetime of the side dams and increase in the casting speed.

2. The process according to claim 1, characterized in that:

the cooling fluid is sprayed through the fixed guides onto the moving side dams after the moving sides dams have travelled through approximately $\frac{1}{3}$ to approximately $\frac{1}{2}$ of the length of the moulding cavity, and continuosly spraying the cooling fluid onto the moving side dams until the moving side dams reach the outlet of the moulding cavity.

3. The process according to claim 1, characterized in that:

the acute angle is in the range between approximately 20° to approximately 50°.

4. The process according to claim 1 or 2, characterized in that:

water is used as the cooling fluid directly sprayed onto the moving side dams in said second zone.

5. The process according to claim 3, characterized in that:

water is used as the cooling fluid directly sprayed onto the moving side dams in said second zone.

6. A process for continuously casting molten metal wherein a moulding cavity having upper and lower walls is formed between two moving endless belts which respectively form the upper and lower walls of the moulding cavity and the side walls are formed by a pair of endless side dams that move with the belts along the moulding cavity from the inlet to the outlet thereof, the upper and lower moving belts being cooled by contact with a cooling liquid, and molten metal in introduced into the inlet and a product is discharged from the outlet which is solidified at least on the outside thereof, the side dams thus passing during their movement along the moulding cavity successively through a first zone in which they face molten metal and a second zone in which they face solidified metal, and the side dams are guided through said first and second zones by a pair of fixed guides extending along near the respective guided side dam in said first and second zones, this process is characterized by:

providing a longitudinal channel in each of the fixed guides in said second zone facing toward the respective guided side dam, in said longitudinal channels directly spraying cooling liquid in a plurality of sprays directed against the moving side dams as they travel along at least a portion of the second zone in which they face solidified metal, spraying said plurality of sprays against the moving side dams at locations spaced along the major portion of said second zone, and allowing the cooling liquid which has been applied to the moving side dams to escape from said channels near the outlet of the moulding cavity.

7. The process according to claim 6, characterized in that:

each side dam has a first surface facing toward the metal in the moulding cavity and a second surface facing away from said metal and the cooling liquid is sprayed directly against the second surface of each moving side dam while being aimed in the downstream direction at an acute angle at each such location for propelling the cooling fluid downstream toward the outlet of the moulding cavity.

8. Continuous casting apparatus including a moulding cavity formed by means of lower and upper moving walls formed by respective lower and upper revolving endless belts each having upper and lower runs, the lower wall being formed by the upper run of said lower endless belt, the upper wall being formed by the lower run of said upper endless belt, and the side walls being formed by a pair of endless side dams, that are adapted to move with the belts along the moulding cavity from the inlet to the outlet thereof, a pair of fixed guides to guide the respective side dams during their movement along the moulding cavity, each of said side dams has an inside surface and an outside surface, said outside surface is adjacent to the respective fixed guide which is guiding the respective moving side dam, means for applying a cooling liquid on the reverse surfaces of the lower and upper walls, and a first zone, in which the inside surface of each of said side dams faces liquid metal when the apparatus is running, and a second zone, in which the inside surface of each of said side dams faces solidified metal when the apparatus is running, said apparatus being characterized in that:

each of the fixed guides defines a cooling chamber therein adapted to the be cooled extending over at least a part of the length of the fixed guide, cooling fluid supply means connected to said chamber for circulation of a cooling liquid in the chamber, each of the fixed guides having a longitudinal channel extending therealong along said second zone adjacent to the outside surface of the moving side dam being guided by the respective fixed guide, each such longitudinal channel having an open end near the outlet of the moulding cavity, each fixed guide having a plurality of fluid spray openings therein communicating with the cooling chamber and being aimed into the longitudinal channel toward the outside surface of the respective side dam being guided by the fixed guide for spraying cooling fluid on the outside surface of the side dam in at least a part of the aforesaid second zone, and said fluid spray openings being aimed in directions that, seen from the inlet of the moulding cavity, form acute angles with the longitudinal channel for propelling the cooling fluid in the longitudinal channel in a downstream direction toward the open end of the channel.

9. Apparatus according to 8, characterized in that:

the means for spraying the cooling fluid on the said dams extend over at least ½ of the length of the moulding cavity along the downstream portion thereof.

10. Apparatus according to claim 8, characterized in that:

the acute angle is in the range between approximately 20° and approximately 50°.

11. Continuous casting apparatus for casting molten metal wherein a moulding cavity having upper and lower walls is formed between two moving belts which respectively form the upper and lower walls of the moulding cavity, and the side walls are formed by a pair of endless side dams that move with the belts along the moulding cavity from the inlet to the outlet thereof, the upper and lower walls being cooled by liquid coolant, and molten metal being introduced into the inlet and a product is discharged from the outlet which is solidified at least on the outside thereof, the side dams thus passing during their movement along the moulding cavity successively through a first zone in which their respective inner surfaces face molten metal and a second zone in which they face solidifed metal, said apparatus comprising:

guide means extending along adjacent to the outer surface of the respective moving side dam for guiding the moving side dam along the moulding cavity and defining a longitudinal channel extending adjacent to the outer surface of the respective moving side dam along at least a portion of said second zone, each longitudinal channel having an open end near the outlet of the moulding cavity, liquid spray means including a plurality of liquid spray orifices located at spaced positions along the respective longitudinal channel, and said spray orifices being aimed in directions that, as seen from the inlet of the moulding cavity form acute angles with the longitudinal channels for spraying liquid coolant directly onto the respective outer surface of the respective moving side dam as it moves along adjacent to said channel along said second zone and for propelling the liquid coolant in the longitudinal channel downstream toward the open end of the channel for escaping through said open end.

12. Continuous casting apparatus according to claim 11, in which:

said means for applying liquid coolant directly onto the moving side dams includes a plurality of spray openings spaced along said channel and aimed toward the outer surface of the moving side dam along the respective channel for spraying the liquid coolant directly onto the outer surface of the moving side dam.

* * * * *